US010293391B2

(12) United States Patent
Keyt

(10) Patent No.: US 10,293,391 B2
(45) Date of Patent: May 21, 2019

(54) COIL SAMPLING STAND AND METHOD OF TAKING COIL SAMPLES

(71) Applicant: NUCOR CORPORATION, Charlotte, NC (U

(72) Inventor: Montgomery Keyt, Greencastle, IN (US)

(73) Assignee: NUCOR CORPORATION, Charlotte, NC (US)

( * ) Notice: Subject to any disclaimer, the term of this patent is extended or adjusted under 35 U.S.C. 154(b) by 456 days.

(21) Appl. No.: 15/084,152

(22) Filed: Mar. 29, 2016

(65) Prior Publication Data

US 2016/0288183 A1 Oct. 6, 2016

Related U.S. Application Data

(60) Provisional application No. 62/140,835, filed on Mar. 31, 2015.

(51) Int. Cl.

| | |
|---|---|
| ***B21C 47/22*** | (2006.01) |
| ***B21C 47/34*** | (2006.01) |
| ***B21C 51/00*** | (2006.01) |

(52) U.S. Cl.

CPC ..... *B21C 47/22* (2013.01); *B21C 47/3441* (2013.01); *B21C 51/00* (2013.01)

(58) Field of Classification Search

CPC ..... B21C 46/16; B21C 47/22; B21C 47/3433; B21C 47/3441; B21C 47/34; B21C 51/00; B21B 2015/0064

See application file for complete search history.

(56) References Cited

U.S. PATENT DOCUMENTS

| | | | | | |
|---|---|---|---|---|---|
| 2,965,328 | A | * | 12/1960 | Groll | B21C 47/22 242/562.1 |
| 3,226,050 | A | * | 12/1965 | Engel | B21C 47/22 242/559.3 |
| 3,330,497 | A | * | 7/1967 | Deschaine | B21C 47/34 242/562.1 |
| 3,461,703 | A | * | 8/1969 | Ranney | B21C 47/34 242/562 |
| 4,070,891 | A | * | 1/1978 | Stretten | B21C 47/16 242/562 |
| 4,549,700 | A | * | 10/1985 | Ganseuer | B23D 33/00 242/527 |

(Continued)

FOREIGN PATENT DOCUMENTS

| | | | | |
|---|---|---|---|---|
| EP | 0497182 A1 | * | 8/1992 | B23D 31/00 |

*Primary Examiner* — Edward T Tolan
(74) *Attorney, Agent, or Firm* — Moore & Van Allen PLLC; Jeffrey R. Gray

(57) ABSTRACT

Aspects of the present invention relate to a coil sampling stand apparatus which generally has a frame, at least two rollers operatively coupled to the frame, a roller drive operatively coupled to at least one of the at least two rollers, and a peeler assembly comprising a peeler (e.g., peeler, knife, member with an edge, or the like) that is configured to engage and disengage a coil between the at least two rollers. The steel coil may be positioned onto the at least two rollers on the frame of the coil sampling apparatus. The peeler is engaged with the coil and the coil is rotated in order to allow the peeler to peel a tail edge of a layer of the coil off the coil and pass the tail edge and layer of the coil peeled off of the coil under at least one of the rollers.

20 Claims, 8 Drawing Sheets

(56) References Cited

U.S. PATENT DOCUMENTS

| | | | | |
|---|---|---|---|---|
| 7,181,946 | B2 * | 2/2007 | Kruger | B21C 47/08<br>242/533.2 |
| 9,770,748 | B2 * | 9/2017 | Hofmann | B21C 47/22 |
| 2004/0245367 | A1 * | 12/2004 | Malard | B21B 38/02<br>242/547 |
| 2008/0190258 | A1 * | 8/2008 | Moser | B21C 47/34<br>83/649 |

* cited by examiner

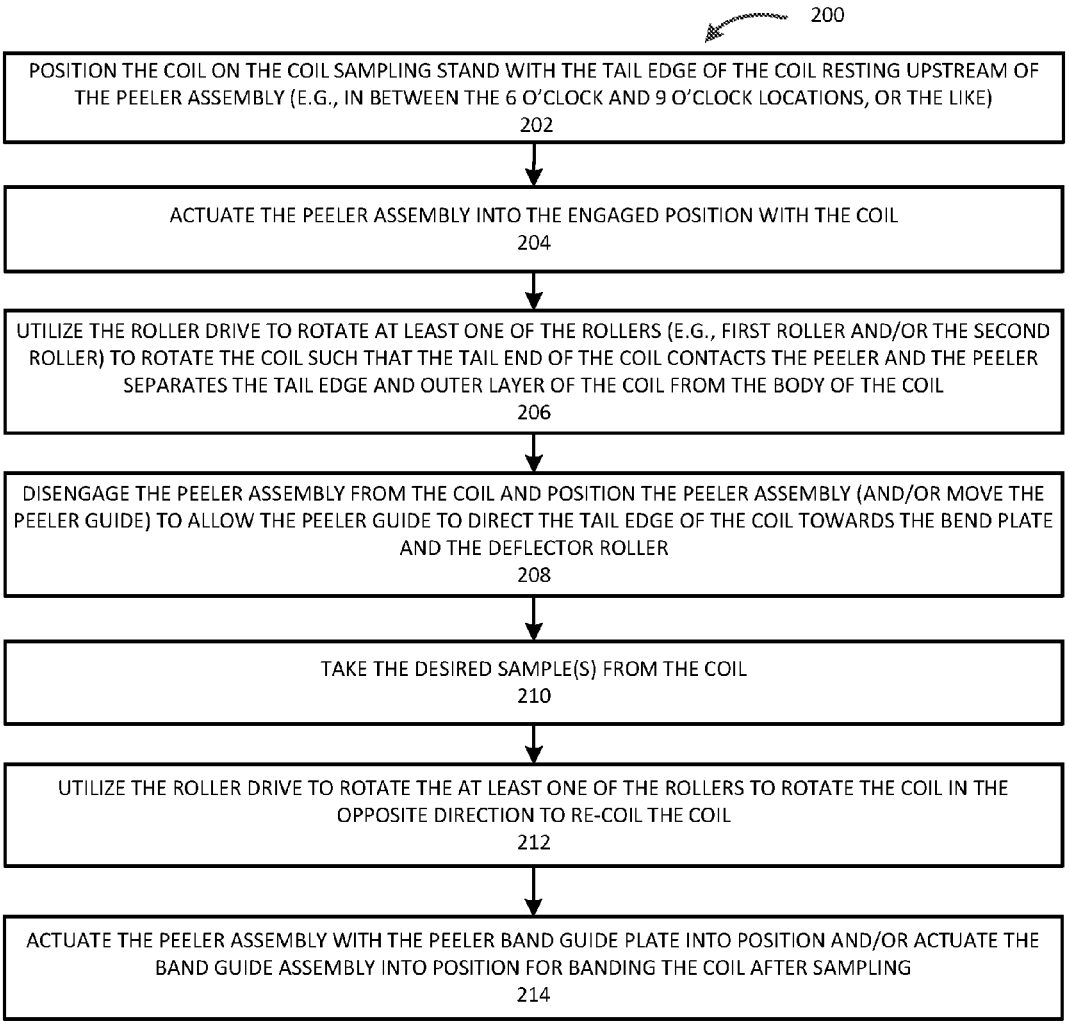
*FIG.* 8

COIL SAMPLING STAND AND METHOD OF TAKING COIL SAMPLES

CLAIM OF PRIORITY UNDER 35 U.S.C. § 119

The present Application for a Patent claims priority to U.S. Provisional Patent Application Ser. No. 62/140,835 entitled "Coil Sampling Stand and Method of Taking Coil Samples" filed on Mar. 31, 2015 and assigned to the assignees hereof and hereby expressly incorporated by reference herein.

FIELD

The present invention relates to apparatuses and methods for taking samples from coils, and in particular steel coils.

BACKGROUND OF THE INVENTION

Before delivering coils to a customer, a manufacturer of the coils or another entity may be required to test one or more locations within the coil in order to confirm the properties of the coil (e.g., material properties, mechanical properties, or the like). As such, different apparatuses and methods are needed to take samples of coils as the coils are unwound.

SUMMARY OF THE INVENTION

The present invention meets the needs discussed above by providing coil sampling apparatuses and methods that result in improved operation, improved safety, and reduces costs associated with taking samples from coils. While the present invention is generally described with respect to steel coils, it should be understood that the apparatuses and methods described herein may be utilized on any type of material that is coiled.

In one embodiment, the coil sampling apparatus generally comprises a frame, at least two rollers operatively coupled to the frame (e.g., a first roller and a second roller), a roller drive operatively coupled to at least one of the at least two rollers (an in some embodiments multiple rollers), and a peeler assembly comprising a peeler (e.g., peeler, knife, member with an edge, or the like) located at least partially between the at least two rollers (e.g., between the first roller and the second roller). The coil may be positioned on the at least two rollers on the frame of the coil sampling apparatus. The tail edge of the coil (e.g., end of the coil roll) may be located upstream of the peeler, such as in the bottom left quarter of the coil (e.g., between 6 o'clock and 9 o'clock when viewing FIGS. 5-7). The peeler is moved into the engaged position (or one of the one or more engaged positions), in which the peeler (or at least a portion thereof, for example, a peeler edge) is positioned on the exterior surface of the coil or adjacent the exterior surface of the coil. The coil is rotated by activating the roller drive which turns at least one of the rollers (e.g., the first roller or the second roller), and in some embodiments multiple rollers (e.g., both the first roller and the second roller). The coil rotates, such as in the counter clockwise direction when viewing the coil side illustrated in FIGS. 5-7. As the coil is rotated, the tail of the coil comes into contact with the peeler, which is located between the at least two rollers, and the peeler separates the outer layer of the coil from the body of the coil in a peeling motion. By unwinding the coil from the bottom, or near the bottom, between the at least two rollers, the process of unwinding the coil provides increased safety because the moving parts of the coil sampling apparatus are hidden within and/or under the frame and/or between the at least two rollers. As such, people near the coil sampling stand apparatus are not exposed to the movement of the peeler or other moving parts of the peeler assembly (or other components discussed herein, such as the guide band assembly). Moreover, the location of the peeler between the two rollers also allows for one roller to contact the exterior surface of the coil before the tail edge is peeled off of the coil and another roller to contact the exterior surface of the coil directly after the tail edge is peeled off of the coil, which reduces the uncoiling force that potentially may cause the coil to rise off of one or more of the rollers, cause the coil to rock within the rollers, and/or cause the coil to roll off of the rollers of the sampling stand apparatus.

Peeling the tail edge and layer off of the coil after both rollers, or before both rollers, exposes people and other machinery adjacent to the sampling stand to the moving parts of the peeler assembly. Moreover, this configuration may also result in an uncoiling force (e.g., from the coil itself or from components pushing against the coil) in which the coil rises off of one or more of the rollers, rocks within the one or more rollers, and/or causes the coil to roll off of the rollers of the sampling stand (e.g., opposite of the side on which the peeler is located) as the tail end is peeled off of the coil and/or bent towards the desired sampling location. These issues may be especially true for coils with thickness gauges of 0.300 to 0.750, and/or coils with diameters that range from 48 inches to 73 inches. However, it should be noted that the sampling stands of the invention described herein may also provide benefits (e.g., shielding the moving parts under the frame, or the like) regardless of the thicknesses and/or size of the coils. As such, the thicknesses and diameters of the coils used with the sampling stand apparatus may be outside of, overlapping, or within the stated ranges. In some embodiments of the invention, the peeler (e.g., through the peeler assembly, or the like) is mounted in such a way that it can be raised or lowered into different positions to accommodate different sized coils (e.g., coils with different diameters) that may have bottom surfaces of the coil body that sit at different vertical locations between the two rollers on the frame. In other embodiments of the invention the one or more rollers may be adjustable and/or replaceable in order accommodate different sized coils.

Aspects of the invention comprise a coil sampling stand. The coil sampling stand comprises a frame; a first roller operatively coupled to the frame; a second roller operatively coupled to the frame; a roller drive operatively coupled to at least one of the first roller or the second roller; and a peeler assembly comprising a peeler. The coil sampling stand is configured to support a coil on the first roller and the second roller, and the peeler assembly is configured to actuate the peeler between at least one peeler engaged position and at least one peeler disengaged position with the coil between the first roller and the second roller. The roller drive rotates the at least one of the first roller or the second roller to turn the coil and to allow the peeler to peel a tail edge of the coil from the coil and pass the tail edge of the coil under the second roller.

In further accord with aspects of the invention, the coil sampling stand further comprises a deflector roll. The deflector roll is configured to direct the tail edge of the coil to the desired location for sampling.

In another aspects of the invention, the coil sampling stand further comprises a bend plate. The bend plate directs the tail edge of the coil into the desired position for sampling.

In still other aspects of the invention, the peeler assembly further comprises a peeler guide. The peeler guide directs the tail edge of the coil into the desired position for sampling.

In yet other aspects of the invention, the peeler assembly further comprises a peeler actuator configured to actuate the peeler into the at least one peeler engaged position and the at least one peeler disengaged position.

In further accord with aspects of the invention, the peeler assembly is operatively coupled to the frame.

In another aspect of the invention, the peeler assembly further comprises a peeler band guide, and the peeler comprises at least one band slot. The peeler band guide and the at least one band slot in the peeler guide are configured to guide a band under the coil for banding the coil.

In still another aspect of the invention, the coil sampling stand further comprises a band guide assembly comprising a band guide with band slots and a band guide actuator. The band guide actuator is configured to actuate the band guide into a banding guide engaged position and a banding guide disengaged position with the coil between the first roller and the second roller. The band guide and the band slots are configured to guide a band under the coil for banding the coil.

In yet another aspect of the invention, the coil sampling stand of claim further comprises one or more coil supports operatively coupled to the frame. The one or more coil supports are configured to support the coil if the coil becomes dislodged from the first roller and the second roller.

Another aspect of the invention is a coil sampling stand. The coil sampling stand comprises a frame; at least two rollers operatively coupled to the frame; and a peeler assembly comprising a peeler. The coil sampling stand is configured to support a coil on the at least two rollers. The peeler of the peeler assembly is configured to be positioned in at least one peeler engaged position and at least one peeler disengaged position with the coil between the at least two rollers. The at least two rollers allow the coil to turn and the peeler to peel a tail edge and layer of the coil from the coil and pass the tail edge of the coil under one of the at least two rollers.

In further accord with aspects of the invention, a first roller of the at least two rollers contacts the coil before the tail edge is peeled from the coil, and a second roller of the least two rollers contacts the coil after the tail edge is peeled from the coil.

In another aspect of the invention, the coil sampling stand further comprises a deflector roll and a bend plate. The deflector roll and bend plate direct the tail edge of the coil to the desired location for sampling.

Another aspect of the invention is a method for peeling a layer from a coil using a sampling stand. The method comprises positioning a coil on the sampling stand, wherein the sampling stand comprises a frame, a first roller operatively coupled to the frame, a second roller operatively coupled to the frame, a roller drive operatively coupled to at least one of the first roller or the second roller, and a peeler assembly comprising a peeler. The method further comprises actuating a peeler into an engaged position with a coil, wherein the peeler is engaged with the coil between the first roller and the second roller. The method also comprises rotating the coil by utilizing the roller drive to turn at least one of the first roller or the second roller. The method additionally comprises peeling a tail edge of a layer of the coil away from the coil using the peeler. The method further comprises directing the tail edge of the layer of the coil under the second roller and towards a sampling location.

In further accord with aspects of the invention, directing the tail edge of the layer of the coil towards the sampling location is done through the use of a deflector roll.

In another aspect of the invention, directing the tail edge of the layer of the coil towards the sampling location is done through the use of a bend plate, wherein the bend plate is operatively coupled to the frame.

In still another aspect of the invention, directing the tail edge of the layer of the coil towards the sampling location is done through the use of a peeler guide, wherein peeler assembly comprises the peeler guide.

In yet another aspect of the invention, the peeler assembly further comprises a peeler actuator. Actuating the peeler into the engaged position with a coil comprises actuating the peeler into the peeler engaged position. The peeler actuator is further configured to actuate the peeler into at least one peeler disengaged position.

In further accord with aspects of the invention, the peeler assembly is operatively coupled to the frame.

In another aspect of the invention, the method further comprises rotating the coil by utilizing the roller drive to turn at least one of the first roller or the second roller for recoiling the coil. The method also comprises actuating a peeler band guide into an engaged position with the coil. The peeler comprises at least one band slot, and the peeler band guide and the at least one band slot in the peeler band guide are configured to guide a band under the coil for banding the coil. The method includes banding the coil.

In still another aspect of the invention, the method further comprises rotating the coil by utilizing the roller drive to turn at least one of the first roller or the second roller for recoiling the coil. The method also comprises actuating a band guide into an engaged position with the coil. The peeler comprises at least one band slot, and the band guide and the at least one band slot in the band guide are configured to guide a band under the coil for banding the coil. The method includes banding the coil.

The features, functions, and advantages that have been discussed may be achieved independently in various embodiments of the present invention or may be combined in yet other embodiments, further details of which can be seen with reference to the following description and drawings.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein:

FIG. 8 illustrates a method of taking a sample from a coil using a coil sampling stand, in accordance with aspects of the invention.

DETAILED DESCRIPTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
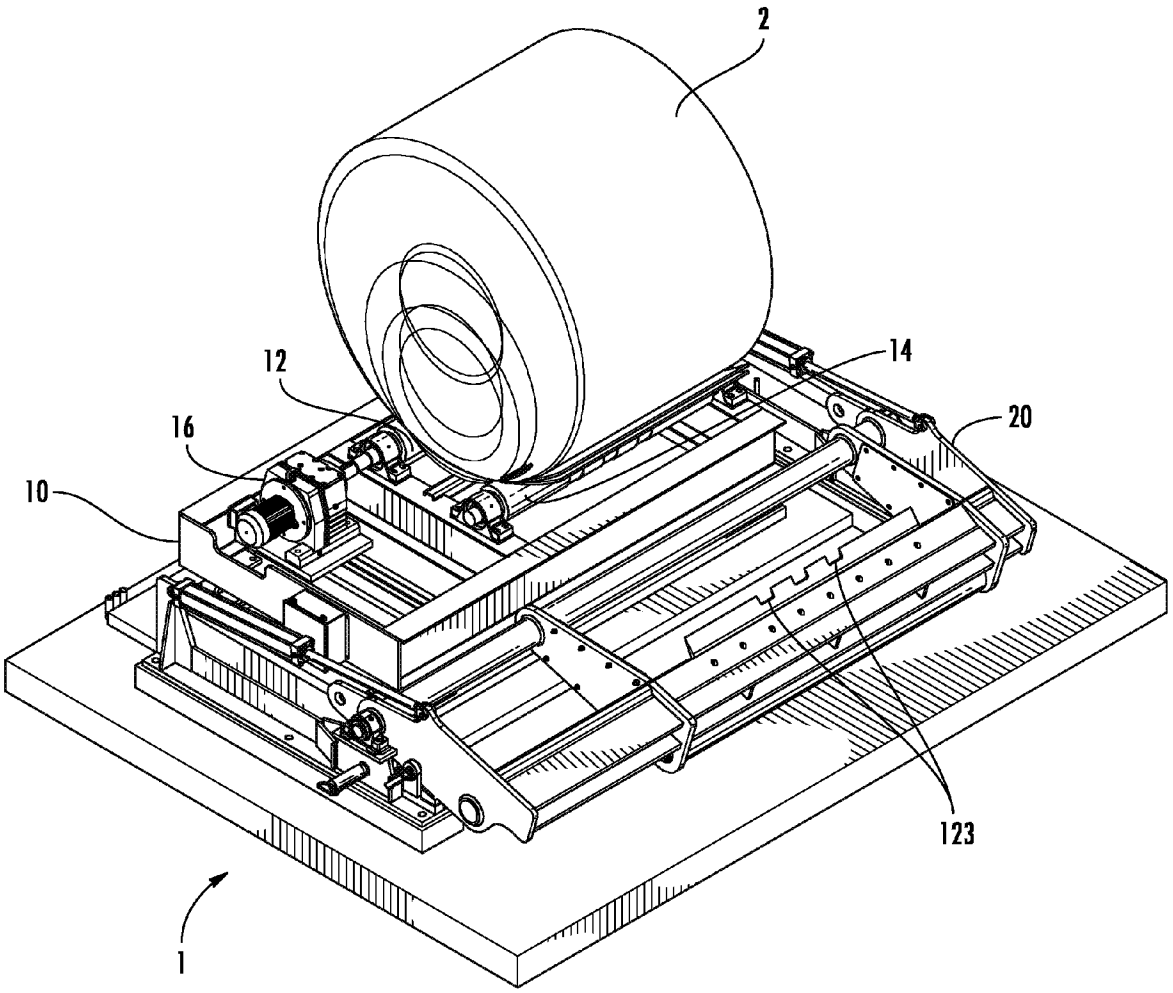
FIG. 1 illustrates a perspective view of one type of coil sampling stand.
Figure 2:
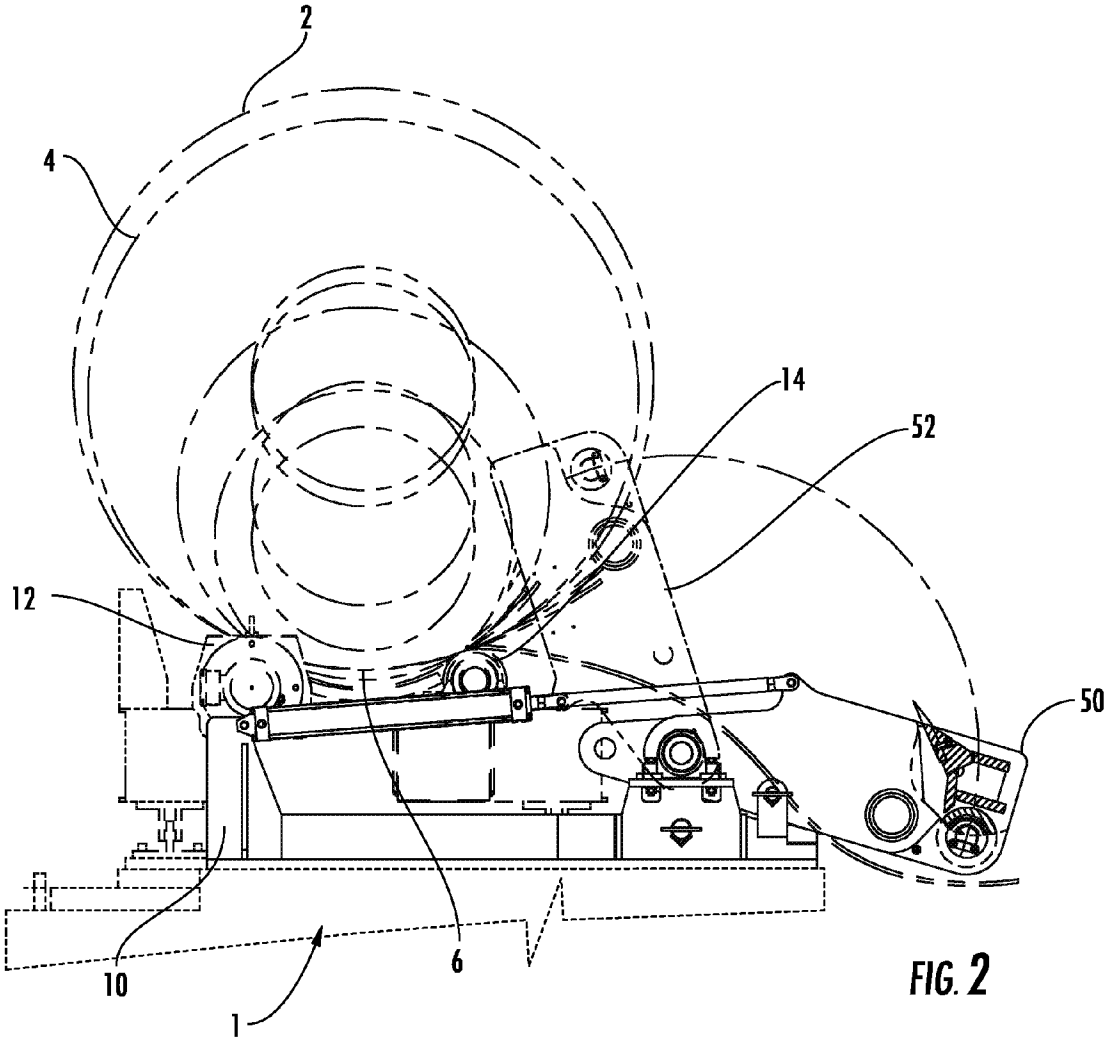
FIG. 2 illustrates a cross-sectional side view of one type of coil sampling stand.
Figure 3:
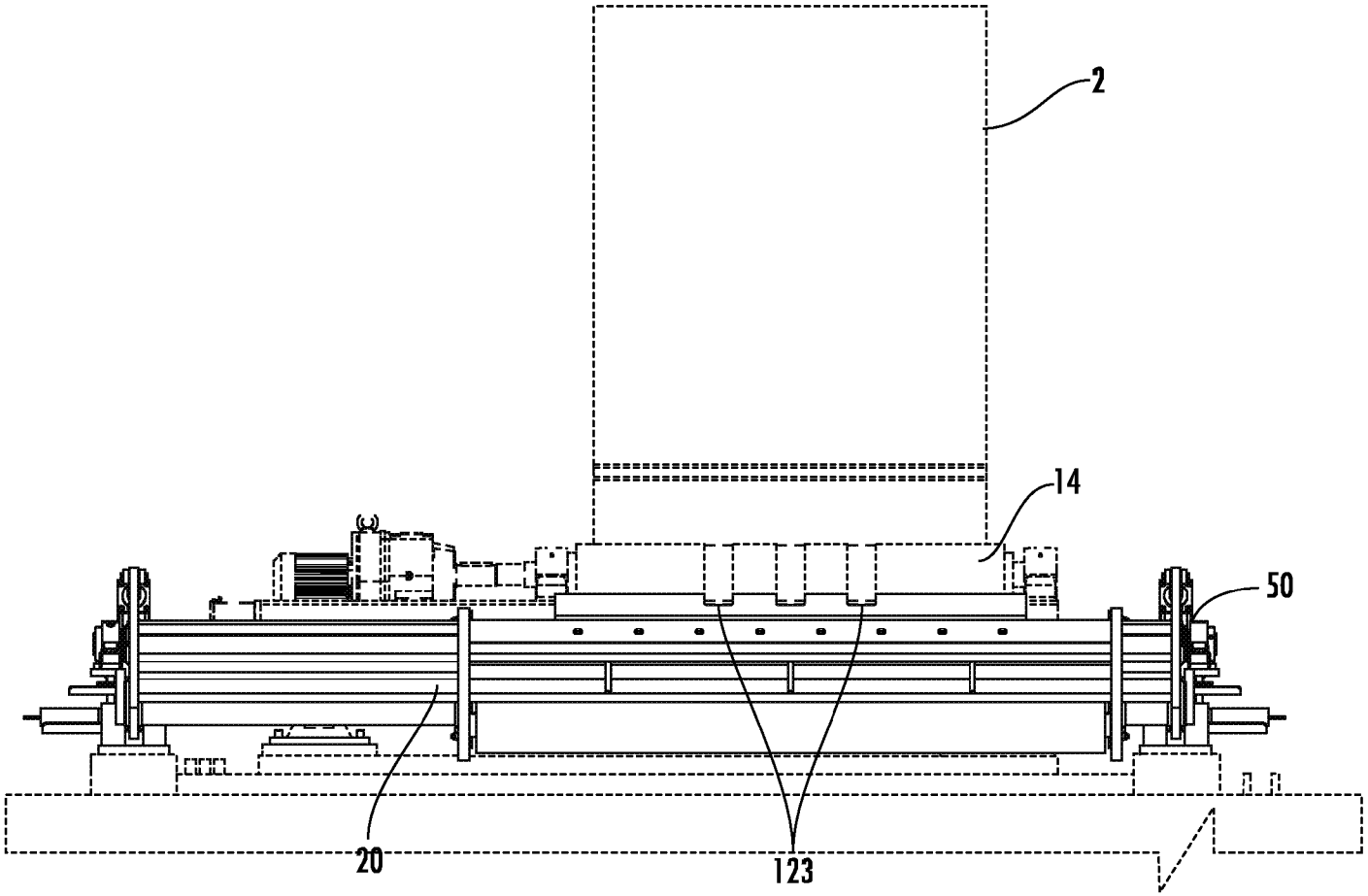
FIG. 3 illustrates a front view of one type of coil stand.
Figure 4:
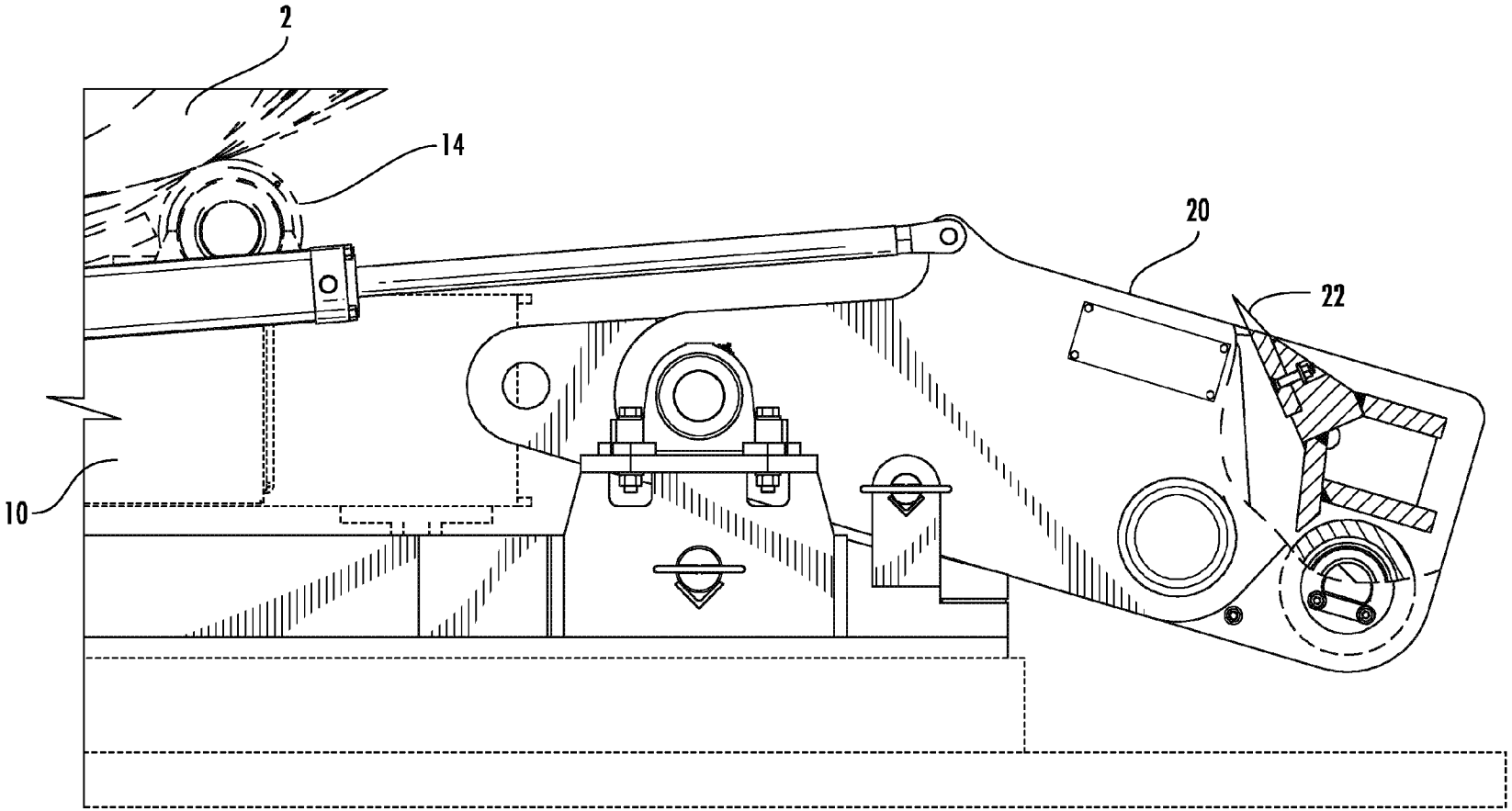
FIG. 4 illustrates a side view of the peeler assembly of one type of coil stand.

FIGS. 1-4 illustrate a perspective view of a coil sampling stand 1. As illustrated in FIGS. 1-4 the coil sampling stand comprises a frame 10, a first roller 12, a second roller 14, and a peeler assembly 20. In FIGS. 1-4 the peeler assembly is configured to actuate between a disengaged position 50 and an engaged position 52. As illustrated by FIG. 2, the peeler assembly swings from the disengaged position 50 to the engaged position 52 to allow the peeler 22 to engage the side of the coil 2 at a position that is above the first and second rollers 12, 14. The peeler assembly 20 swings between the engaged position 52 and disengaged position 50 adjacent the coil 2. As such, the peeler assembly 20 could potentially injure people standing adjacent the coil sampling stand 1 as it is being engaged or disengaged from the coil 2. In the illustrated embodiment in FIGS. 1-4 the force of the peeler assembly 20 on the side of the coil 2 and/or an unwinding force from the peeler 22 separating the strip from the coil 2, may cause the coil 2 to rock between the first roller 12 and the second roller 14. In some situations the coil may rock off of the rollers 12, 14 and frame 10, and cause damage to people or other machinery located adjacent the coil sampling stand 1.

Figure 5:
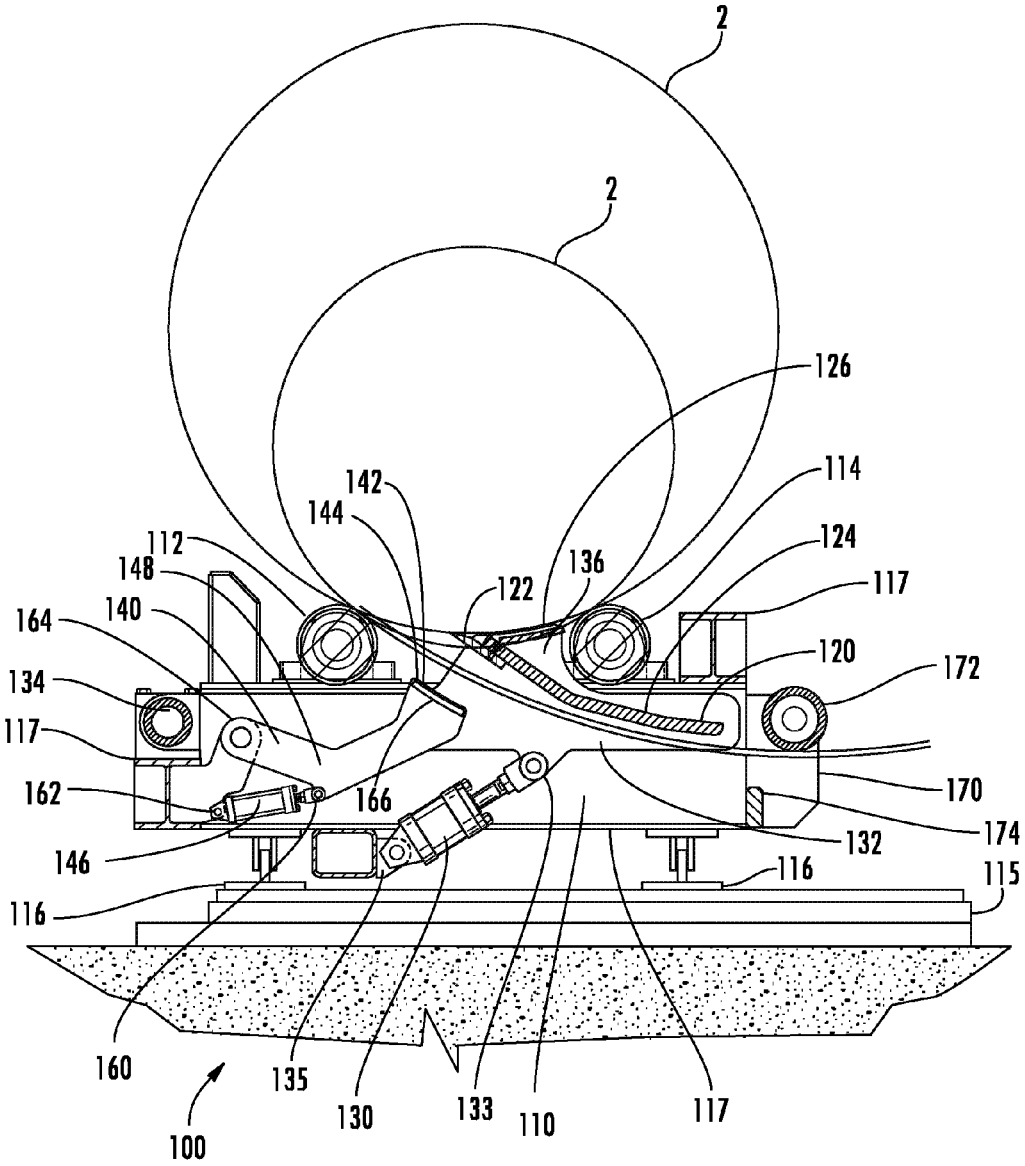
FIG. 5 illustrates a cross-sectional view of one type of coil sampling stand with a peeler assembly engaged with the coil and a guide band assembly disengaged with the coil, in accordance with aspects of the invention.
Figure 6:
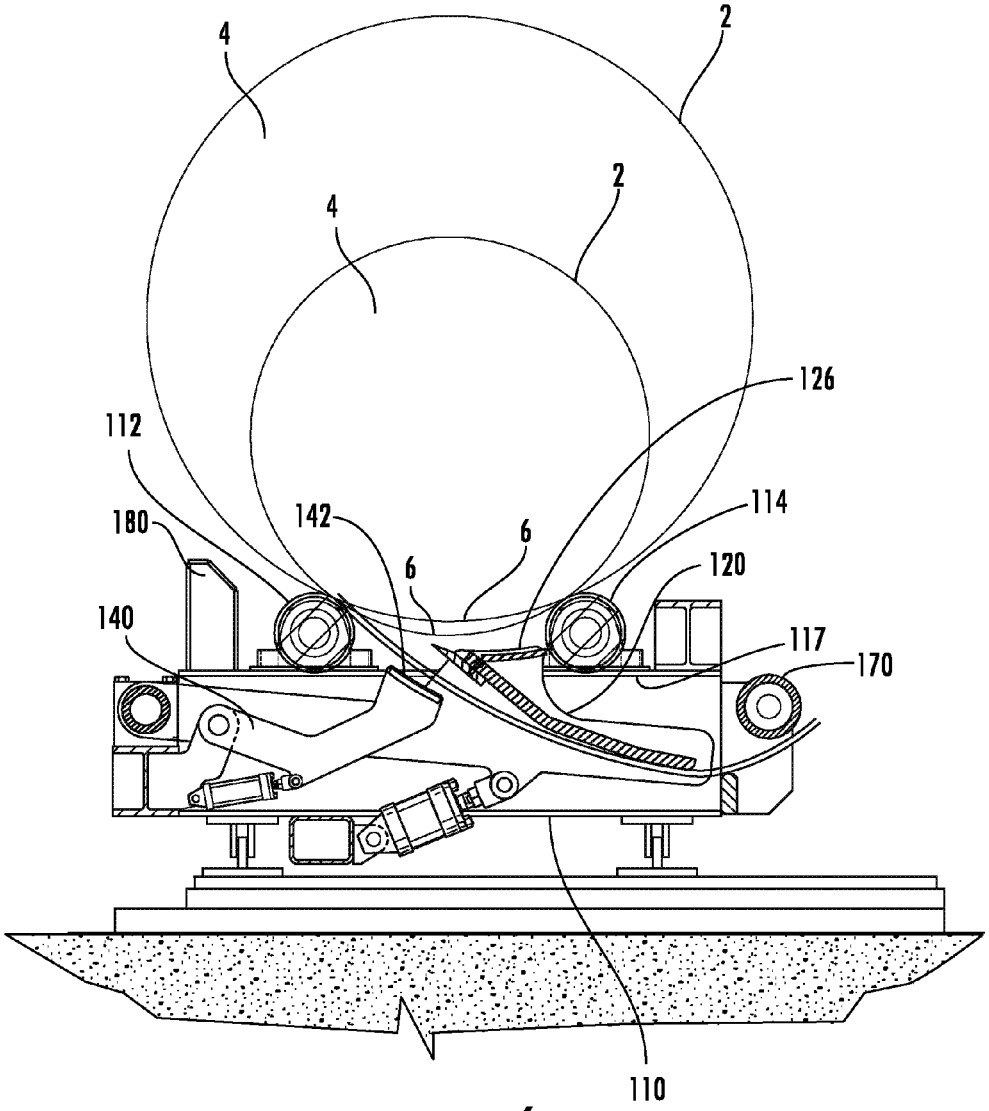
FIG. 6 illustrates a cross-sectional view of one type of coil sampling stand with the peeler assembly and the guide band assembly disengaged from the coil, in accordance with aspects of the invention.
Figure 7:
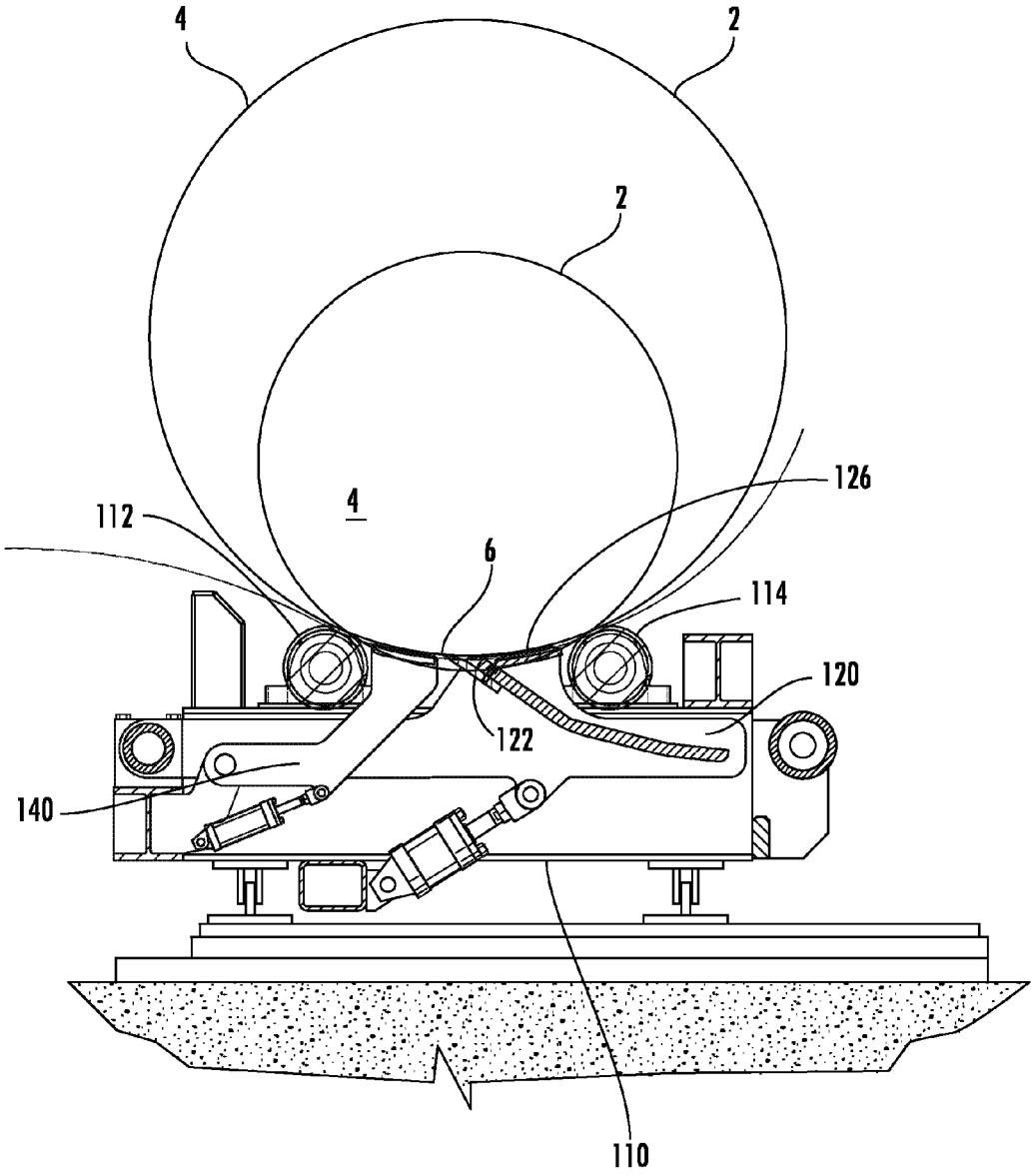
FIG. 7 illustrates a cross-sectional view of one type of coil stand with the peeler assembly and the guide band assembly engaged with the coil, in accordance with aspects of the invention.

FIGS. 5 through 7 illustrate another embodiment of the coil sampling stand 100 comprising a frame 110, a peeler assembly 120, a guide band assembly 140, and a deflector assembly 160. As illustrated in FIGS. 5-7, the peeler assembly 120 is located between the rollers, as described in further detail later.

As illustrated in FIGS. 5-7, the frame 110 may comprise a first roller 112, a second roller 114, a foundation 115, weigh cells 116 (e.g., for weighing the coil), and one or more support members 117. The support members 117 may support the first roller 112 and the second roller 114. The weight cells 116 are utilized for weighing the coils and supporting the one or more support members 117. The foundation 115 supports the weight cells 116. In other embodiments of the invention there may be more than two rollers on which the coil 2 rests. The first roller 112 and the second roller 114 may be spaced any distance apart from one another. Moreover, the first roller 112 and the second roller 114 may be located on the same horizontal plane or may be located on different horizontal planes such that one roller may be located vertically above the other roller. As such, the rollers 112, 114 may be spaced apart such that when a coil 2 is placed on the rollers 112, 114, the rollers 112, 114 are located in any location on the bottom half of the coil (e.g., between 3 o'clock and 9 o'clock when viewing the coil from the coil side illustrated in FIGS. 5-7). It should be further understood that any size coil 2 may be utilized on the coil sampling stand 100, such that the rollers 112, 114 will sit at different locations on the coils 2 depending on the size of the coil 2 (e.g., diameter of the coil). For example, as illustrated in FIGS. 5-7 the outline of two different sized coils 2 are illustrated as resting on the rollers 112, 114 such that the bottom surfaces 6 of the coils are located on different horizontal planes. It should be understood that in some embodiments of the invention one or more of the rollers (e.g., a first roller 112 and/or a second rollers 114) may be adjustable and/or replaced with rollers with different diameters. As such, the one or more adjustable rollers may be adjusted in any direction (e.g., up, down, left, right, etc.) in order to account for different sized coils. Moreover, in some aspects of the invention the rollers may be replaceable with rollers that have a larger and/or smaller diameter in order to support different sized coils.

The peeler assembly 120 comprises a peeler 122 (e.g., a blade, knife, edged member, or the like) that is configured to peel the first layer off of the coil 2. The peeler assembly 120 further comprises a peeler guide 124 which is configured to guide the peeled layer of the coil 2 to the sampling location. The peeler assembly 120 may further comprise a peeler band guide 126, which may be configured to help in banding the coil 2, as described in further detail later. In some embodiments the peeler 122 and/or the peeler band guide 126 (as well as the rollers 112, 114) may also have banding slots 123, which allows the coil 2 to rotate while the peeler 122 is engaged with a surface of the coil 2 and the bands (e.g., illustrated in FIG. 7) are being installed around the coil 2 or are in the process of being installed.

The peeler assembly 120 may further comprise a peeler actuator 130, which may be a hydraulic, pneumatic, electrical, mechanical, and/or other like type of actuator that is configured to engage and disengage the peeler 122 with the coil 2. The peeler actuator 130 may be operatively coupled to a peeler support member 132 at a first peeler tab location (e.g., at a peeler support actuator tab location 133). The peeler actuator 130 may be operatively coupled to the frame 110 at a second peeler frame location (e.g., a frame actuator location 135). The peeler support member 132 may be operatively coupled to the frame 110 at a peeler support frame end 134 (e.g., at a first end of the peeler support member using a pivot trunnion, or the like) and operatively coupled to the peeler 122, the peeler guide 124, and/or the peeler band guide 126 at a peeler support member end 136 (e.g., at a second end of the peeler support member). In some embodiments of the invention, the peeler support actuator tab location 133 and/or the frame actuator location 135 may be the same as or different than the peeler support frame end 134 and/or the peeler support member end 136 of the peeler support member 132. In some embodiments of the invention the peeler assembly 120 may be operatively coupled to the frame 110 that supports the coil 2 (as illustrated in FIGS. 5-7), or in other embodiments it may be a located separate from the frame 110.

As illustrated by FIGS. 5-7 the peeler assembly 120, and/or the peeler 122 itself, is located between the first roller 112 and the second roller 114 under the coil 2 as the coil 2 is supported by the frame 110 of the coil sampling stand 100. As such, during the actuation of the peeler assembly 120 between the engaging position 152 and one or more disengaging positions 150 the moving parts of the actuation assembly 120, or at least some of the parts therein, are located under the coil 2 on the sampling stand 100, and thus, away from people or other types of machinery that could be damaged by the movement of the peeler assembly 120. As illustrated in FIGS. 5-7 since the movement (e.g., at least the majority of the movement, or the like) of the peeler assembly 120 occurs under or within the frame 110 between the rollers 112, 114 the operators or bystanders near the sampling stand 100 are less likely to get injured by the moving components of the peeler assembly 120. Additionally, since the peeling of the tail edge of the coil 2 from the coil body 4 occurs on a bottom surface 6 of the coil 2, between the first roller 112 and the second roller 114, the coil 2 is less likely to rock on the rollers 112, 114 and/or roll off of the rollers 112, 114. In other coil samplers, in which the peeler assembly 20 is configured to peel the tail section on the side of the coil (see FIGS. 1-4), the coil 2 may rock and/or roll off of the coil sampling stand 1 because of the force of peeling the tail edge away from the coil 2 and bending the peeled layer away from the coil 2. The effect of peeling the coil 2 using the peeler assembly 120 located between a first roller 112 and a second roller 114, is that the coil 2 unwinds in a more natural unwinding position (see FIGS. 5-7) that is less likely to cause the coil 2 to rock and/or roll off of the coil sampling stand 100.

As previously discussed, the peeler guide 124 may be a part of the peeler assembly 120, and is used to help guide the tail end and the layer of the coil 2 peeled from the coil body 4 to the desired sampling location. In some embodiments of the invention the peeler guide 124 may be operatively coupled to the peeler 122 and moves along with the peeler 122 (and the peeler assembly 120) as the peeler 122 is moved between the engaged position 152 (or one or more engaged positions) and the disengaged position 150 (or one or more disengaged positions). The one or more engaged positions and one more ore disengaged positions may be based on the size of the coil being sampled. As such, as the tail edge and layer are peeled from the coil 2 the peeler guide 124 directs the tail edge and coil layer to towards the desired sampling location. Furthermore, during peeling, the peeler 122 (and as such the peeler guide 124) may be moved to one or more of the disengaged positions 150 to further direct the tail edge and coil layer towards the desired sampling location. For example, based on the diameter of the coil 2 (e.g., the bottom 6 of the coil sits between the rollers), the thickness of the coil 2, and/or the unwinding tendency of the tail edge and coil layer, peeler guide 124 adjustments may be required to direct the tail edge and coil layer to the desired sampling location. In other embodiments of the invention the peeler guide 124 may operate independently of the peeler 122 (e.g., actuate independently of the peeler 122), and thus, may be positionable in different orientations (e.g., vertical, horizontal, rotational, or the like) to guide the tail edge and coil layer the desired sampling location.

The peeler band guide 126 may be utilized to help guide a band used to secure the coil 4 before transport. In some embodiments the band guide 126 may be operatively coupled to the peeler 122, or may operate independently of the peeler 122. In some embodiments the peeler 122 and/or peeler band guide 126 (as well as the rollers) may have slots 123 that allow for a band to be fed around the coil 4 in order to secure the coil 4 for transport (e.g., as illustrated in FIG. 7). In some embodiments the peeler band guide 126 may be a part of the peeler assembly 120, as previously described, may be a separate assembly that can be actuated independently from the peeler assembly 120, or may be operatively coupled to or work with another assembly, such as the band guide assembly 140 discussed in further detail below.

FIGS. 5-7 also illustrate a band guide assembly 140, which comprises a band guide 142 that is configured to help guide a band around the coil when banding the coil for transport (e.g., shipping, or the like). The band guide 142 may further comprise guide band slots 144 that help to guide the band in the proper orientation and/or guide the band through the banding slots 123 in the peeler 122 and through the peeler band guide 126, which all may be utilized to feed the band by the rollers (e.g., through slots in the rollers, between spaces in the rollers, or the like) and under the coil 2 on the sampling stand 100 in order to band the coil 2 (e.g., as illustrated in FIG. 7). The band guide assembly 140 further comprises a band guide actuator 146, which like the peeler actuator 130 may be a hydraulic, pneumatic, electrical, mechanical, and/or other like type of actuator that is configured to engage and disengage the band guide assembly 140 with a surface, or adjacent to the surface of the coil 2. The band guide actuator 146 may be operatively coupled to a band guide support member 148 at a band guide tab location 160 (e.g., at a band guide actuator tab) and to the frame 110 at a band guide frame location 162. The band guide support member 148 may be operatively coupled to the fame 110 at a band guide support frame end 164 (e.g., at a first end of the band guide support member 148 using a pivot trunnion, fastener, or the like) and operatively coupled to the band guide 142 in a band guide support member end 166 (e.g., at a second end of the band guide support member 148). In some embodiments of the invention, the band guide tab location 160 and/or the band guide frame location 162 may be the same as or different than the first end 164 or second end 166 of the band guide support member 148. In some embodiments of the invention the band guide assembly 140 may be operatively coupled to the frame 110 that supports the coil 2 (as illustrated in FIGS. 5-7), or in other embodiments it may be a located separate from the frame 110.

In some embodiments of the invention the band guide assembly 140 and/or the peeler band guide 126 may be a single band guide assembly 140 that works in conjunction with each other. As such, the single band guide assembly 140 may have a first band guide and a second band guide, which are located near or adjacent to the first roller 112 and/or the second roller 114 in order to allow the coil to be banded after sampling and before transport.

The coil sampling stand 100 may further comprise a deflector assembly 170 which may be operatively coupled to the frame 110 or may be located separate from the frame 110. The deflector assembly 170 may comprise a deflector roll 172 and/or a bend plate 174 which may assist in delivering the peeled tail end and coil layer of the coil 2 to the desired location for sampling. As illustrated in FIG. 6, the peeler assembly 120 may be positioned to deliver the tail edge of the coil 2 and the coil layer to the bend plate 174 and/or the deflector roll 172, which rotates in order to facilitate the delivery of the layer of the coil 2 to the sampling location. In the illustrated embodiment in FIG. 6, the deflector roll 172 is located above the layer of the coil 2 that is peeled off of the coil 2, but in other embodiments of the invention it should be understood that the deflector roll 172 may be located below the layer of the coil that is peeled off of the coil 2, such that the layer peeled off of the coil 2 is positioned above or below the roller 172. In the illustrated embodiment the bend plate 174 is located below the layer of the coil 2 that is peeled off of the coil 2, however, in other embodiments the bend plate 174 may be located above the layer from the coil 2. In still other embodiments of the invention, additional bend plates or guides may be utilized to direct the layer peeled from the coil 2 to the desired location adjacent the coil 2 for sampling.

In still other embodiments of the invention, the deflector assembly 170 or additional rollers, plates, or guides may be located between and/or below the first roller 112 and the second roller 114 in order to direct the layer peeled from the coil 2 to the desired location for sampling.

In some embodiments of the invention, the coil sampling stand 100 may further comprise one or more coil supports 180, which may be utilized to prevent the coil 2 from rolling off of the rollers 112, 114 and/or the frame 110. If the coil 2 does roll off of the rollers 112, 114. The one or more coil supports 180 may be useful in preventing injury to people or damage to machinery located near the coil sampling stand 100; however, the coil supports 180 may still damage at least a part of the coil 2 if the coil was to rock or roll off of the rollers 112, 114. As such, even with the one or more coil supports 180, reducing the tendency of the coil 2 to roll off of the rollers 112, 114, and/or frame 110 by peeling the tail end from the coil 2 at or near the bottom surface 6, such as the surface located between the rollers 112, 114, provides an improved coil sampling stand 100.

FIG. 8 illustrates a process flow for sampling coils 200, in accordance with aspects of the invention. As illustrated by block 202 in FIG. 8, the coil is positioned on the coil sampling stand 100 with the tail edge of the coil 2 resting upstream of the peeler assembly 120. For example, the tail end of the coil may be located between the 6 o'clock and 9 o'clock locations when viewing the coil and sampling stand 100 from a side view (as see in FIGS. 5-6). In other embodiments of the invention, the tail end of the coil may be located in any orientation on the coil 2, and the rollers 112, 114 may be utilized (as discussed in further detail later) in order to rotate the tail end of the outer layer of the coil 2 to the desired location for peeling the tail end away from the coil 2.

Block 204 of FIG. 8 illustrates that the peeler assembly 120 may be actuated into the engaged position 152 (or one or more engaged positions based on the size of the coil in the stand) with the bottom surface 6 of the coil 2 or adjacent the bottom surface 6 of the coil 2. As such, an edge of the peeler 122 of the peeler assembly 120 is positioned along the outer surface of the coil 2, or adjacent the outer surface of the coil 2, between the first roller 112 and the second roller 114 located under the coil 2 at or near the bottom 6 of the coil 2.

As illustrated by block 206 of FIG. 8, the roller drive (16 in FIG. 1 and not illustrated in FIGS. 5-7) is engaged in order to rotate at least one of the rollers (e.g., a first roller 112 and/or a second roller 114) to rotate the coil 2 such that the tail end of the coil comes in contact with the edge of the peeler 122, and the peeler 122 separates the tail end and the outer layer of the coil 2 from the coil 2. It should be understood that the location of the peeler assembly 120, and thus peeler 122, between the two rollers 112, 114 allows for one roller to contact the exterior surface of the coil before the tail edge is peeled off of the coil and another roller to contact the exterior surface of the coil directly after the tail edge is peeled off of the coil, which reduces the uncoiling force that potentially may cause the coil to rise off of one or more of the rollers, cause the coil to rock within the rollers, and/or cause the coil to roll off of the rollers of the sampling stand apparatus.

Block 208 of FIG. 8 further illustrates that the peeler assembly 120, and thus the peeler 122, is disengaged from the coil 2 (e.g., from the surface of the coil and/or adjacent the surface of the coil), and the peeler assembly 120 is positioned (e.g., in one or more of a number of disengaged positions 150 or peeler assembly guide positions) to allow the peeler guide 124 to direct the tail edge of the coil 2 to the sampling location directly. In other embodiments the peeler guide 124 may direct the tail edge of the coil 2 towards a bend plate 174 and/or the deflector roller 172 of the deflector assembly 170 to ultimately direct the tail edge and/or layer of the coil 2 to the sampling location. In other embodiments the peeler guide 124 may operate independently of the peeler 122 and/or the peeler assembly 120 to direct the tail edge and/or layer of the coil 2 to the sampling location.

Block 210 of FIG. 8 illustrates that the desired sample(s) from the tail edge and/or coil layer are taken from the coil 2. For example, the samples are taken from the leading tail edge of the layer, from the side edges of the layer, and/or from the middle of the layer of the coil 2. In some embodiments samples of the coil are taken using a gas operated torch, a plasma torch, cutting, or other like means to remove a portion of sheet from the layer of the coil 2.

As illustrated by block 212 in FIG. 8, after the coil sampling is completed, the roller drive is used to rotate the at least one of the rollers (e.g., the first roller 112 and/or the second roller 114) to rotate the coil 2 in the opposite direction to re-coil the coil 2 (e.g., rotate in the counter clockwise direction when viewing the coil from the side illustrated in FIGS. 5-7). This operation retracts the tail edge of the layer of the coil 2 from under the coil sampling stand 100 and back between the first roller 112 and the second 114. As such, the coil 2 is returned to a wound or coiled configuration.

Block 214 of FIG. 8 illustrates that the peeler assembly 120 with the peeler guide band 126 is actuated into position near and/or against the outer surface of the coil 2. Moreover, the band guide assembly 140 with the band guide 142 may also be actuated into position near and/or against the outer surface of the coil 2. In this configuration, the peeler guide band 126 of the peeler assembly 120 and/or the band guide 142 of the band guide assembly 140 may be placed into a position that allows for one or more bands to be used to band the coil 2 for future transport. In some embodiments the one or more bands are threaded under the coil 2 and above or between the rollers 112, 114 through the roller slots (or spaces between rollers, peeler guide 126 and peeler guide slots 123 and/or the band guide 142 and band guide slots 144. As such, the bands may be assembled to the coil 2 after sampling, while the coil 2 is located on the coil sampling stand 100.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A coil sampling stand, the coil sampling stand comprising:

a frame;

two or more rollers operatively coupled to the frame, wherein the two or more rollers comprise a first roller operatively coupled to the frame and a second roller operatively coupled to the frame; and a roller drive operatively coupled to at least one of the two or more rollers;

a peeler assembly comprising a peeler;

wherein the coil sampling stand is configured to support a coil on the first roller and the second roller, and wherein the first roller and the second roller support the coil on a bottom half of the coil;

wherein the peeler assembly is configured to actuate the peeler between at least one peeler engaged position and at least one peeler disengaged position with the coil, and wherein the at least one peeler engaged position occurs between the first roller and the second roller on the bottom half of the coil; and wherein the roller drive rotates the at least one of the two or more rollers to turn the coil and to allow the peeler to peel a tail edge of the coil from the coil and pass the tail edge of the coil under the second roller.

2. The coil sampling stand of claim 1, further comprising:

a deflector roll;

wherein the deflector roll is configured to direct the tail edge of the coil to a location for sampling.

3. The coil sampling stand of claim 1, further comprising:

a bend plate, and wherein the bend plate directs the tail edge of the coil into a location for sampling.

4. The coil sampling stand of claim 1, wherein the peeler assembly is operatively coupled to the frame, wherein the peeler assembly further comprises a peeler actuator configured to actuate the peeler into the at least one peeler engaged position and the at least one peeler disengaged position, and wherein the peeler assembly further comprises a peeler guide configured to direct the tail edge of the coil into a location for sampling.

5. The coil sampling stand of claim 1, wherein there are no other rollers between the first roller and the second roller at the bottom half of the coil.

6. The coil sampling stand of claim 1, wherein the first roller and the second roller are stationary rollers that maintain contact with the coil when the coil is placed on the coil sampling stand.

7. The coil sampling stand of claim 1, wherein the peeler assembly further comprises a peeler band guide, wherein the peeler comprises at least one band slot, and wherein the peeler band guide and the at least one band slot in the peeler band guide are configured to guide a band under the coil for banding the coil.

8. The coil sampling stand of claim 1, further comprising:

a band guide assembly comprising a band guide with band slots and a band guide actuator;

wherein the band guide actuator is configured to actuate the band guide into a banding guide engaged position and a banding guide disengaged position with the coil between the first roller and the second roller; and wherein the band guide and the band slots are configured to guide a band under the coil for banding the coil.

9. The coil sampling stand of claim 1, further comprising:

one or more coil supports operatively coupled to the frame; and wherein the one or more coil supports are configured to support the coil if the coil becomes dislodged from the first roller and the second roller.

10. A method for peeling a layer from a coil using a coil sampling stand, the method comprising:

positioning a coil on the coil sampling stand, wherein the coil sampling stand comprises a frame, two or more rollers comprising a first roller and a second roller, wherein the two or more rollers are operatively coupled to the frame, a roller drive operatively coupled to at least one of the two or more rollers, and a peeler assembly comprising a peeler, wherein the first roller and the second roller support the coil on a bottom half of the coil;

actuating the peeler into an engaged position with a coil, wherein the peeler is engaged with the coil between the first roller and the second roller on the bottom half of the coil;

rotating the coil by utilizing the roller drive to turn the at least one of the two or more rollers;

peeling a tail edge of a layer of the coil away from the coil using the peeler; and directing the tail edge of the layer of the coil under the second roller and towards a sampling location.

11. The method of claim 10, wherein directing the tail edge of the layer of the coil towards the sampling location is done through the use of a deflector roll.

12. The method of claim 10, wherein directing the tail edge of the layer of the coil towards the sampling location is done through the use of a bend plate, wherein the bend plate is operatively coupled to the frame.

13. The method of claim 10, wherein directing the tail edge of the layer of the coil towards the sampling location is done through the use of a peeler guide, wherein peeler assembly comprises the peeler guide.

14. The method of claim 10, wherein there are no other rollers between the first roller and the second roller at the bottom half of the coil.

15. The method of claim 10, wherein the first roller and the second roller are stationary rollers that maintain contact with the coil when the coil is placed on the coil sampling stand.

16. The method of claim 10, further comprising:

rotating the coil by utilizing the roller drive to turn the at least one of the two or more rollers for recoiling the coil;

actuating a peeler band guide into an engaged position with the coil, wherein the peeler comprises at least one band slot, and wherein the peeler band guide and the at least one band slot in the peeler band guide are configured to guide a band under the coil for banding the coil; and banding the coil.

17. The method of claim 10, further comprising:

rotating the coil by utilizing the roller drive to turn the at least one of the two or more rollers for recoiling the coil;

actuating a band guide into an engaged position with the coil, wherein the peeler comprises at least one band slot, and wherein the band guide and the at least one band slot in the band guide are configured to guide a band under the coil for banding the coil; and banding the coil.

18. A coil sampling stand, the coil sampling stand comprising:

a frame;

at least two rollers operatively coupled to the frame;

a peeler assembly comprising a peeler; and wherein the coil sampling stand is configured to support a coil on the at least two rollers on a bottom half of the coil;

wherein the peeler of the peeler assembly is configured to be positioned in at least one peeler engaged position and at least one peeler disengaged position with the coil between the at least two rollers on the bottom half of the coil; and wherein the at least two rollers allow the coil to turn and the peeler to peel a tail edge and layer of the coil from the coil between the at least two rollers on the bottom half of the coil and pass the tail edge of the coil under one of the at least two rollers.

19. The coil sampling stand of claim 18, wherein a first roller of the at least two rollers contacts the coil before the tail edge is peeled from the coil, and wherein a second roller of the at least two rollers contacts the coil after the tail edge is peeled from the coil.

20. The coil sampling stand of claim 18, further comprising:

a deflector roll;

a bend plate; and wherein the deflector roll and bend plate direct the tail edge of the coil to a location for sampling.

* * * * *